US006557503B2

(12) United States Patent
Hampson

(10) Patent No.: US 6,557,503 B2
(45) Date of Patent: May 6, 2003

(54) METHOD FOR LOWERING FUEL CONSUMPTION AND NITROGEN OXIDE EMISSIONS IN TWO-STROKE DIESEL ENGINES

(75) Inventor: Gregory James Hampson, Saratoga Springs, NY (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/682,221

(22) Filed: Aug. 8, 2001

(65) Prior Publication Data

US 2003/0029397 A1 Feb. 13, 2003

(51) Int. Cl.[7] ..... F02F 7/00
(52) U.S. Cl. ..... 123/48 A
(58) Field of Search ..... 123/78 A, 78 R, 123/27 R, 48 B, 78 F, 78 E, 48 A

(56) References Cited

U.S. PATENT DOCUMENTS 4,510,895 A * 4/1985 Slee ..... 123/193.6
5,522,359 A * 6/1996 Collin ..... 123/305
5,826,563 A 10/1998 Patel et al.
6,158,413 A * 12/2000 Kimura et al. ..... 123/306
6,213,086 B1 * 4/2001 Chmela et al. ..... 123/276
6,318,308 B1 * 11/2001 Hsu et al. ..... 123/48 A

OTHER PUBLICATIONS

U.S. patent application S.N. 09/412,627 entitled "Increased Compression Ratio Diesel Engine Assembly For Retarded Fuel Injection Timing".

*Internal Combustion Engine Fundamentals*, J.P. Heywood, McGraw Hill, 1988, "Engine Types and Their Operation", pp. 1–14, 25, 235.

* cited by examiner

*Primary Examiner*—Henry C. Yuen
*Assistant Examiner*—Hyder Ali
(74) *Attorney, Agent, or Firm*—Armstrong Teasdale LLP; Robert B. Reeser, III

(57) ABSTRACT

A method of lowering fuel consumption and $NO_x$ levels in a two-stroke diesel engine having at least one piston disposed in at least one combustion chamber comprises the steps of providing a compression ratio within the combustion chamber between about 16.5:1 to about 19:1, providing a ratio of peak pressure to compressed pressure within the combustion chamber below about 1.4; and providing a trapped air charge density within the combustion chamber of at least 2.77 kg/m$^3$. Combustion within the diesel engine results in $NO_x$ levels in exhaust gases below a predetermined amount and fuel consumption below a predetermined amount.

40 Claims, 1 Drawing Sheet

METHOD FOR LOWERING FUEL CONSUMPTION AND NITROGEN OXIDE EMISSIONS IN TWO-STROKE DIESEL ENGINES

CROSS REFERENCE TO RELATED APPLICATIONS

This Application is related to commonly assigned, copending application Ser. No. 09/41 2627, filed Oct. 4, 1999, entitled "Increased Compression Ratio Diesel Engine Assembly For Retarded Fuel Injection Timing," which application is herein incorporated by reference.

BACKGROUND OF INVENTION

The present invention relates to high power output, medium speed diesel engines. More particularly, the present invention relates to a method of lowering fuel consumption and nitrogen oxide emissions in two-stroke diesel engines.

High power output, medium speed, two-stroke diesel engines are used in various transportation applications, such as locomotives and marine engines. Among the problems associated with such engines is the level of nitrogen oxide emissions (hereinafter referred to as "NOx") in two-stroke diesel engines. As NOx emission standards become more stringent, diesel engines of this type must be modified or manufactured to further reduce such emissions.

For existing two-stroke diesel engine designs, particularly for those engines that are currently in use, one approach to meeting emissions requirements is to retard the start of fuel injection. However, fuel timing retard, which is usually performed during engine rebuild, compromises engine performance by reducing fuel efficiency.

Therefore what is needed is a method of reducing NOx emissions for a two-stroke diesel engine while maintaining the fuel efficiency of the engine. This is of particular importance at rated (or full) speed and load.

SUMMARY OF INVENTION

A method of lowering fuel consumption and $NO_x$ levels in a two-stroke diesel engine having at least one piston disposed in at least one combustion chamber comprises the steps of providing a compression ratio within the combustion chamber between about 16:1 to about 19:1, providing a ratio of peak pressure to compressed pressure within the combustion chamber below about 1.4; and providing a trapped air charge density within the combustion chamber of at least 2.77 $kg/m^3$. Combustion within the diesel engine results in $NO_x$ levels in exhaust gases below a predetermined amount and fuel consumption below a predetermined amount.

BRIEF DESCRIPTION OF DRAWINGS

The FIGURE is a schematic of a two-stroke diesel engine.

DETAILED DESCRIPTION

Figure 1:
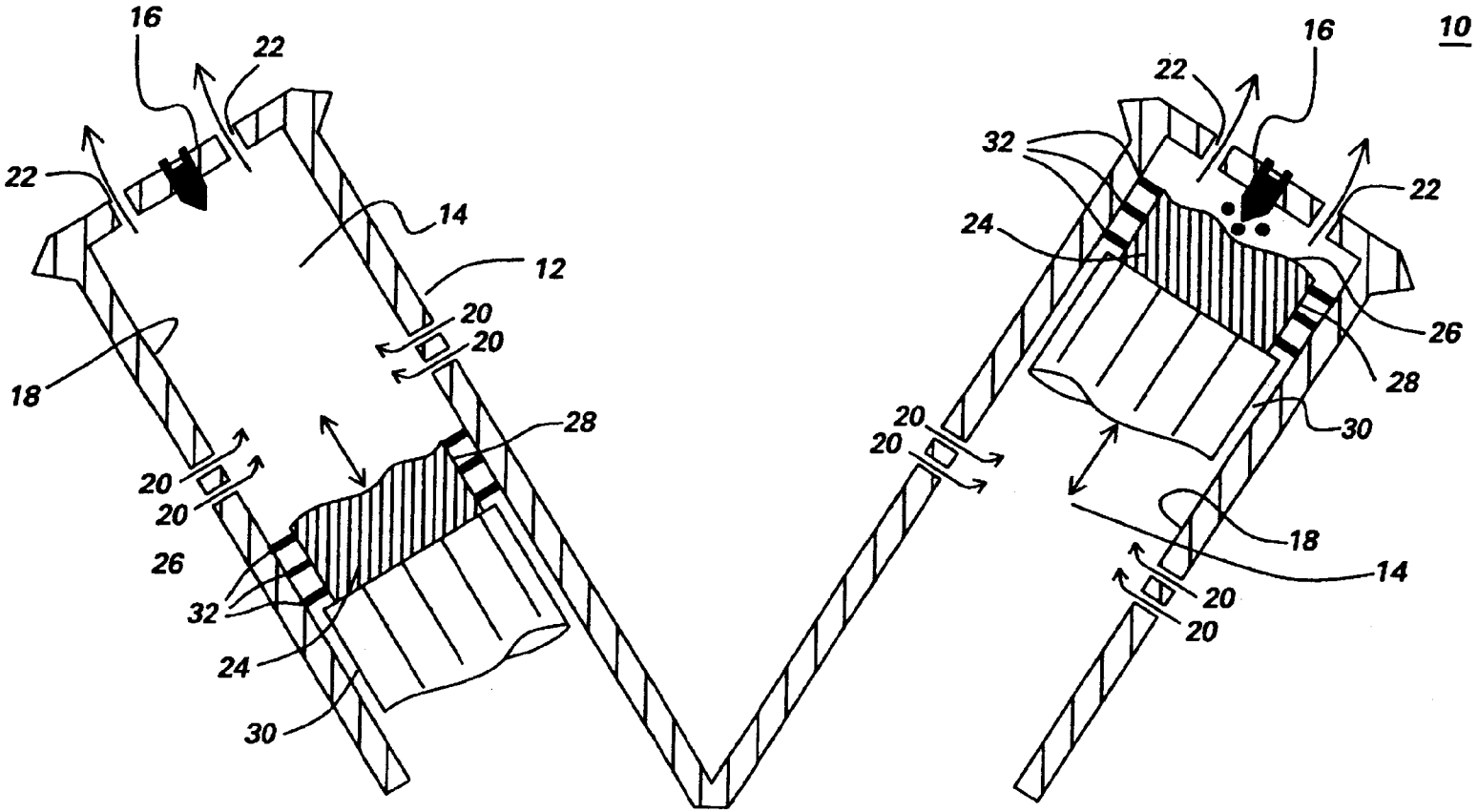

In the following description, like reference characters designate like or corresponding parts throughout the several views shown in the figures. It is also understood that terms such as "top,""bottom,""outward,""inward," and the like are words of convenience and are not to be construed as limiting terms.

Referring to the drawings in general and to FIG. 1 in particular, it will be understood that the illustrations are for the purpose of describing a preferred embodiment of the invention and are not intended to limit the invention thereto.

A two-stroke diesel engine is shown in FIG. 1. The principles of design and operation of internal combustion engines, and of two-stroke diesel engines in particular, are well known in the art and, for the sake of brevity, are not recited here. Such information may be found, for example, in Internal Combustion Engine Fundamentals, J. B. Heywood, McGraw-Hill, 1988, pp. 1–14, 25 and 235.

FIG. 1 is a cross sectional view of an exemplary two-stroke cycle diesel engine 10 such as a locomotive engine. Engine 10 includes an engine block 12 that defines a pair of cylinders or combustion chambers 14, each including a cylinder head 16 and a circumferential wall liner 18. A combustion air intake port 20 and exhaust gas port 22 communicate through each cylinder head 16 with cylinders 14. Cylinder head 16 also includes fuel injection ports (not shown) communicating with a fuel injector (not shown). While the present invention is described in the context of a locomotive, it is recognized that the benefits of the invention accrue to other applications of diesel engines. Therefore, this embodiment of the invention is intended solely for illustrative purposes and is in no way intended to limit the scope of application of the invention.

A piston 24 is slidingly disposed in each cylinder 14 and includes a crown surface 26 adjacent cylinder head 16, and a circumferential sidewall surface 28 spaced from cylinder 14 by a predetermined clearance gap 30. Piston 24 includes a plurality of closely spaced, annular grooves (not shown), each of which is configured to receive an annular, split, compression ring seal 32 for establishing a compression seal between piston sidewall surface 28 and cylinder liner 18. Each piston 24 reciprocates inside of cylinder 14 between a bottom-dead-center (BDC) stroke position in which piston crown surface 26 and cylinder head 16 are at their furthest relative distance and a top-dead-center (TDC) stroke position in which piston crown surface 26 and cylinder head 16 are at their closest relative distance. Thus, each cylinder 16 has a maximum working volume above piston crown surface 26 when piston 24 is at BDC, and a minimum working volume above piston crown surface 26 when piston is at TDC. The ratio of BDC volume to TDC volume is known as the compression ratio of cylinder 14.

In order to keep a cylinder 14 firing pressure within designed allowable structural limits of engine 10, the compression ratio of engine 10 is comparatively low relative to smaller diesel engines, and typically ranges from about 12 to about 16 in conventional two-stroke diesel engines. However, as described in detail below, engine 10 operates with an increased compression ratio producing a peak firing pressure in cylinders 14 comparable to firing pressures at conventional fuel injection timing, i.e., non-retarded fuel injection timing. Consequently, engine 10 retains fuel efficiency despite fuel injection timing retardation. Thus engine 10 may be operated at retarded fuel injection timing to reduce the generation of $NO_X$ without compromising engine efficiency and without incurring reduced cylinder firing pressures, therefore more fully utilizing the structural capability of the engine, and curbing the generation of CO, PM and smoke emissions.

In one embodiment, the present invention provides a high power output two-stroke diesel engine 10 having low NOx emissions and optimal fuel efficiency. The diesel engine 10 may be used in transportation applications such as, but not limited to, locomotives, buses and marine vessels.

In order to meet lower NOx emission standards, existing high power output diesel engines undergo a fuel injection timing retard adjustment when each engine is rebuilt. Due to the late combustion and the lower peak cylinder pressure resulting from the fuel injection retard, the fuel efficiency of the engine is reduced.

In another embodiment, the present invention provides several methods for recovering or maintaining the fuel efficiency of the original, non-rebuilt engine by restoring the peak cylinder combustion pressure, during rebuild of the diesel engine, to that of the original engine specifications. Means for recovering peak cylinder combustion pressure of the original design include injection timing optimization and changing the engine's compression ratio (hereinafter referred to as "CR"), valve timing, and turboboost during rebuild. In addition, the degree of timing retard can be reduced by a reduction of the temperature of the fresh air charge or manifold air temperature.

Accordingly, the present invention achieves the objective by providing a method of lowering fuel consumption by raising engine efficiency while reducing NOx emissions. The method comprises providing a compression ratio of between about 16.5:1 and about 19:1, a peak pressure to compression pressure ($P_{peak}/P_{comp}$) ratio of below about 1.4, and a trapped fresh air charge density of at least 2.77 kg/m$^3$ at BDC. Combustion within the diesel engine results in $NO_x$ levels in exhaust gases below a predetermined amount, for example less than about 9.7 g/bhp-hr at EPA Tier 0 and 7.4 g/bhp-hr at EPA Tier 1 and fuel consumption below a predetermined amount, for example Specific Fuel Consumption (SFC) of less than about 0.36 lb/bhp-hr.

In the present invention, the compression ratio of each combustion chamber 25 within the diesel engine is adjusted to a value between about 16.5:1 and about 19:1, with a compression ratio of about 18:1 being preferred. In one embodiment of the invention, the desired effective compression ratio is achieved by modifying the valve timing rather than the geometric compression ratio in order to accomplish the desired combustion induced pressure rise ratio.

In another embodiment of the invention, the desired compression ratio is achieved by providing a combustion chamber 25 having a volume of less than about 325 cm$^3$. The combustion chamber 25 volume may, if needed, be modified to obtain the desired compression ratio when the diesel engine is rebuilt. In order to obtain the desired combustion chamber 25 volume, the combustion chamber 25 volume, in most cases, must be reduced. Several methods may be used to reduce the combustion chamber 25 volume. A piston shim, for example, may be inserted into the combustion chamber 25. The rod-to-piston top length may be increased by using a longer piston rod. Gasket or firing ring inserts can also be installed in the combustion chamber 25. The piston itself can be modified to reduce the combustion chamber 25 volume. The piston land may, for example, be extended. Alternatively, the volume of the piston bowl can be reduced. In addition, the combustion chamber 25 may be strengthened via internal or external welding of the liner 18 to the cylinder head 16 as well as strengthening the liner 18 via either the addition of a secondary cylinder or increasing the number of head bolts.

In addition to providing a compression ratio in the range of between about 16.5:1 and about 19:1, a peak pressure to compression pressure ($P_{peak}/P_{comp}$) ratio below about 1.4 within the combustion chamber 25 is also provided by the present invention. In one embodiment, the desired $P_{peak}/P_{comp}$ ratio is provided by retarding the fuel injection timing by between about 1° and 4°. If the fuel injection system is a mechanical fuel injection system, the fuel injection timing can be retarded by rotating the fuel cam by between about 1° and 4°. Alternatively, either a hydraulic or electronic fuel delay may be used to retard the fuel injection timing.

In another embodiment of the present invention, the desired $P_{peak}/P_{comp}$ ratio is provided by providing a means for changing the fuel delivery rate to the combustion chamber. In one embodiment, the fuel delivery rate for a mechanical fuel injection system is adjusted by modifying the rate of rise of the fuel cam. A two-solenoid system may be used to change the fuel delivery rate in an electronic fuel injection system.

The present invention also provides a trapped fresh air charge density of at least about 2.77 kg/m$^3$ at BDC to the combustion chamber 25. In one embodiment, the desired trapped fresh air density is provided by providing a turboboost of between about 2.6 and about 3 atm and, preferably, between about 2.8 and about 2.9 atm. The turboboost may be adjusted by either expanding or contracting the turbine nozzle ring area. Alternatively, the shape of turbocharger blades or other components may be modified to achieve the desired turboboost or equivalent at rated speed and load under standard atmospheric conditions.

In another embodiment of the present invention, the desired trapped fresh air charge density may be achieved by increasing the efficiency of the turbocharger to at least 54%, with a turbocharger efficiency of between about 56% and about 58% being preferred. Certain modifications to the turbocharger, such as, for example, sculpting the diffuser to obtain a predetermined geometry, may be used to achieve the desired turbocharger efficiency.

In addition to providing the desired combustion induced pressure rise ratio, $P_{peak}/P_{comp}$ ratio, and trapped fresh air charge density, the present invention provides for further reduction of NOx emissions and increases in fuel efficiency may be achieved by providing a manifold temperature of up to about 180° F. (about 82° C.) and, preferably, between about 140° F. (about 60° C.) and about 150° F. (about 66° C.). In one embodiment, manifold temperature may be maintained in the desired range using a spilt cooling coolant circuit or a multiple pass after-cooler employing four or more coolant passage loops. The split coolant circuit may further include a control system to vary the flow between different segments of the circuit as needed to maintain the manifold temperature at the desired temperature. Alternatively, manifold temperature may be maintained at the desired level with air-to-air cooling of the air within the manifold.

While typical embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

What is claimed is:

1. A method of lowering fuel consumption and $NO_x$ levels in a two-stroke diesel engine having at least one piston disposed in at least one combustion chamber comprising the steps of:

providing a compression ratio within said combustion chamber between about 16.5:1 to about 19:1;

providing a ratio of peak pressure to compressed pressure within said combustion chamber below about 1.4; and providing a trapped air charge density within said combustion chamber of at least 2.77 kg/m$^3$;

wherein combustion within said diesel engine results in $NO_x$ levels in exhaust gases below a predetermined amount and fuel consumption below a predetermined amount.

2. A method in accordance with claim 1, further comprising maintaining a manifold temperature up to 180° F.

3. A method in accordance with claim 2, wherein said manifold temperature is maintained in the range between about 140° F. to about 150° F.

4. A method in accordance with claim 2, wherein said manifold temperature is maintained using a split cooling coolant circuit.

5. A method in accordance with claim 4, further comprising a control system for variable flow between circuits.

6. A method in accordance with claim 2, wherein said manifold temperature is maintained with air to air cooling of manifold air.

7. A method in accordance with claim 1, wherein said compression ratio is 18:1.

8. A method in accordance with claim 1, wherein said combustion ratio is provided by maintaining a combustion chamber volume less than about 325 $cm^3$.

9. A method in accordance with claim 8, wherein said combustion chamber volume is maintained by a method selected from the group consisting of inserting a piston shim, increasing the rod to piston top length, reducing the volume of the piston bowl, providing a gasket or firing ring insert, and extending the piston about 2.1 mm.

10. A method in accordance with claim 1, wherein said compression ratio is provided through a modified valve timing to change the effective compression ratio.

11. A method in accordance with claim 1, wherein said ratio of $P_{peak}$ to $P_{comp}$ is provided by retarding the timing 1–4°.

12. A method in accordance with claim 11, wherein said timing is retarded by rotating a fuel cam 1 to 4°.

13. A method in accordance with claim 11, wherein said timing is retarded by providing a hydraulic fuel delay.

14. A method in accordance with claim 11, wherein said timing is retarded by providing an electronic fuel delay.

15. A method in accordance with claim 1, wherein said ratio of $P_{peak}$ to $P_{comp}$ is provided by changing the fuel delivery rate.

16. A method in accordance with claim 15, wherein said fuel delivery rate is changed by altering a cam rate of rise.

17. A method in accordance with claim 15, wherein said fuel delivery rate is changed using a two solenoid system.

18. A method in accordance with claim 1, wherein said trapped air charge density is provided by using a turboboost of between about 2.66 to about 3.0 atm.

19. A method in accordance with claim 18, wherein said turboboost is between about 2.8 to about 2.9 atm.

20. A method in accordance with claim 1, wherein said trapped air charge density is provided by providing a turbo efficiency of greater than about 54%.

21. A method in accordance with claim 20, wherein said turbo efficiency is in the range between about 56% to about 58%.

22. A method of providing a combustion ratio between about 16:1 to about 19:1 in a two-stroke diesel engine, the method comprising the steps of:

providing at least one combustion chamber; and providing a piston disposed within a respective combustion chamber wherein the combustion chamber volume is less than about 325 $cm^3$.

23. A method in accordance with claim 22, wherein said combustion chamber volume is provided by inserting a piston shim.

24. A method in accordance with claim 22, wherein said combustion chamber volume is provided by increasing the rod to piston top length.

25. A method in accordance with claim 22 wherein said combustion chamber volume is provided by reducing the volume of the piston bowl.

26. A method in accordance with claim 22, wherein said combustion chamber volume is provided by using a gasket ring insert.

27. A method in accordance with claim 22, wherein said combustion chamber volume is provided by extending the piston about 2.1 mm.

28. A method in accordance with claim 22, further including modifying the valve timing to change the effective combustion ratio.

29. A two-stroke diesel engine for operation at retarded fuel injection timing, said engine comprising:

an engine block comprising two combustion chambers; and a piston slidably disposed in each of said combustion chambers;

wherein the compression ratio within said combustion chamber is between about 16.5:1 to about 19:1, the ratio of peak pressure to compressed pressure within said combustion chamber is below about 1.4, and the air charge density within said combustion chamber is at least 2.77 $kg/m^3$, such that combustion within said diesel engine results in $NO_x$ levels in exhaust gases below a predetermined amount and fuel consumption below a predetermined amount.

30. A two-stroke diesel engine in accordance with claim 29, further comprising maintaining a manifold temperature below about 180° F.

31. A two-stroke diesel engine in accordance with claim 29, wherein said compression ratio is 18:1.

32. A two-stroke diesel engine in accordance with claim 29, wherein said combustion ratio is provided by maintaining a combustion chamber volume less than about 325 $cm^3$.

33. A two-stroke diesel engine in accordance with claim 32, wherein said combustion chamber volume is maintained by inserting a piston shim, increasing the rod to piston top length, reducing the volume of the piston bowl, providing a gasket or firing ring insert, or extending the piston about 2.1 mm.

34. A two-stroke diesel engine in accordance with claim 29, wherein said ratio of peak pressure to compressed pressure is provided by retarding the timing 1–4°.

35. A two-stroke diesel engine in accordance with claim 34, wherein said timing is retarded by rotating a fuel cam 1 to 4°.

36. A two-stroke diesel engine in accordance with claim 29, wherein said trapped air charge density is provided by using a turboboost of between about 2.66 to about 3.0 atm.

37. A two-stroke diesel engine in accordance with claim 29, wherein said trapped air charge density is provided by providing a turbo efficiency of greater than about 54%.

38. A method of retrofitting a two-stroke diesel engine for operation at retarded fuel injection timing, said two-stroke diesel engine having at least one piston disposed in at least one combustion chamber comprising the steps of:

modifying said diesel engine to provide a compression ratio within said combustion chamber between about 16.5:1 to about 19:1;

modifying said diesel engine to provide a ratio of peak pressure to compressed pressure within said combustion chamber below about 1.4; and modifying said diesel engine to provide a trapped air charge density within said combustion chamber of at least 2.77 kg/m3;

wherein combustion within said diesel engine results in NOx levels in exhaust gases below a predetermined amount and fuel consumption below a predetermined amount.

39. A method of lowering fuel consumption and NOx levels in a two-stroke diesel engine having at least one piston disposed in at least one combustion chamber comprising:

a step for providing a compression ratio within said combustion chamber between about 16.5:1 to about 19:1;

a step for providing a ratio of peak pressure to compressed pressure within said combustion chamber below about 1.4; and a step for providing a trapped air charge density within said combustion chamber of at least 2.77 kg/m3;

wherein combustion within said diesel engine results in NOx levels in exhaust gases below a predetermined amount and fuel consumption below a predetermined amount.

40. A two-stroke diesel engine having at least one piston disposed in at least one combustion chamber comprising:

means for providing a compression ratio within said combustion chamber between about 16.5:1 to about 19:1;

means for providing a ratio of peak pressure to compressed pressure within said combustion chamber below about 1.4; and means for providing a trapped air charge density within said combustion chamber of at least 2.77 kg/m3;

wherein combustion within said diesel engine results in NOx levels in exhaust gases below a predetermined amount and fuel consumption below a predetermined amount.

* * * * *